United States Patent [19]

Hein, III et al.

[11] Patent Number: 4,969,382

[45] Date of Patent: Nov. 13, 1990

[54] PITCH CHANGING DEVICE FOR GUITAR

[75] Inventors: Gary L. Hein, III, Decatur; Douglas S. Hein, Elk Grove, both of Ill.

[73] Assignee: Lincoln Diagnostics, Inc., Decatur, Ill.

[21] Appl. No.: 476,936

[22] Filed: Feb. 8, 1990

[51] Int. Cl.[5] ..... G10D 3/04

[52] U.S. Cl. ..... 84/319

[58] Field of Search ..... 84/319

[56] References Cited

U.S. PATENT DOCUMENTS

| | | | |
|---|---|---|---|
| 1,748,053 | 2/1930 | Blair | 84/319 |
| 2,435,512 | 2/1948 | Richmond | 84/319 |
| 3,741,065 | 6/1973 | Harris | 84/319 |
| 3,854,368 | 12/1974 | Pogan | 84/319 |
| 4,170,917 | 10/1979 | Wheelock | 84/319 |

*Primary Examiner*—Lawrence R. Franklin

*Attorney, Agent, or Firm*—Lockwood, Alex, FitzGibbon & Cummings

[57] ABSTRACT

A pitch changing device or slide bar for a guitar. The device is tubular and the outer surface tapers from an enlarged midportion toward the opposite ends so as to provide a generally convex exterior which allows the player to selectively engage only a single guitar string at a time or any two adjacent strings at a time.

4 Claims, 1 Drawing Sheet

PITCH CHANGING DEVICE FOR GUITAR

FIELD OF THE INVENTION

This invention relates to a new and improved pitch changing device for use by guitar players. Such devices have been sometimes referred to as slide bars.

Heretofore, pitch changing devices or slide bars have been used in the form of cylindrical tube lengths formed of a suitable material such as metal, plastic of glass. The bores or openings through the pieces of tube have been such size that a guitar player can quickly place one of the devices on his little finger or ring finger and quickly remove it therefrom when desired. The function and purpose of a slide bar is to change the pitch as a string is being played by increasing or decreasing the effective length of a string.

In playing a guitar, the player normally uses the fingers to press the strings against the fret board thereby producing a variety of notes of different pitch. In playing certain types of music on a guitar, e.g. The Blues, it is desirable to have a smooth and continuous transition from one note to another as distinguished from the usual discrete change achieved when the player's finger presses a string down at one particular location and changes to another note by pressing the string down in a different location. Cylindrical pitch changing devices or slide bars have previously been used to produce such smooth and continuous transitions.

The fret boards of guitars are flat or planar and the guitar strings are essentially parallel and co-planar at a uniform distance above the frets on the fret board. In view of this arrangement, when a cylindrical slide bar or pitch changing device of the prior art is used, only the two outermost strings can be singled out and pressed down by applying the slide bar at an angle. However, it is desired to press down on an intermediate string with a cylindrical slide bar the pressing down of additional strings cannot be avoided since if one intermediate string is engaged all of the strings are engaged. Such downward pressure on adjacent strings creates unwanted "drag noise" from the adjacent strings which interferes with the smooth and continuous transition of notes from the selected string or strings.

SUMMARY OF THE INVENTION

The object of the present invention is to provide pitch changing devices or slide bars which overcome the drawbacks and unwanted features of the prior cylindrical slide bars and which permit the player to engage only a single selected string of a guitar, or if desired two adjacent strings, without engaging any unwanted string. The object of the invention is achieved by providing a slide changing device in the form of a tube which has a convex outer surface so that when the device is applied by the player, there will be a low point or locus on the device or slide bar which can be applied to any one string or any two selected strings.

A further object of the invention is the provision of a pitch changing device for guitars the outer surface of which is convex and provided by end portions which have frusto-conical surfaces interconnected by a middle or intermediate portion having an arcuate convex surface whereby the device provides a low point or locus which may be applied to a single string or two adjacent strings.

For a more complete understanding of the nature and scope of the invention reference may be had to the following detailed description of a preferred embodiment thereof taken in connection with the accompanying drawings wherein:

DETAILED DESCRIPTION

Figure 1:
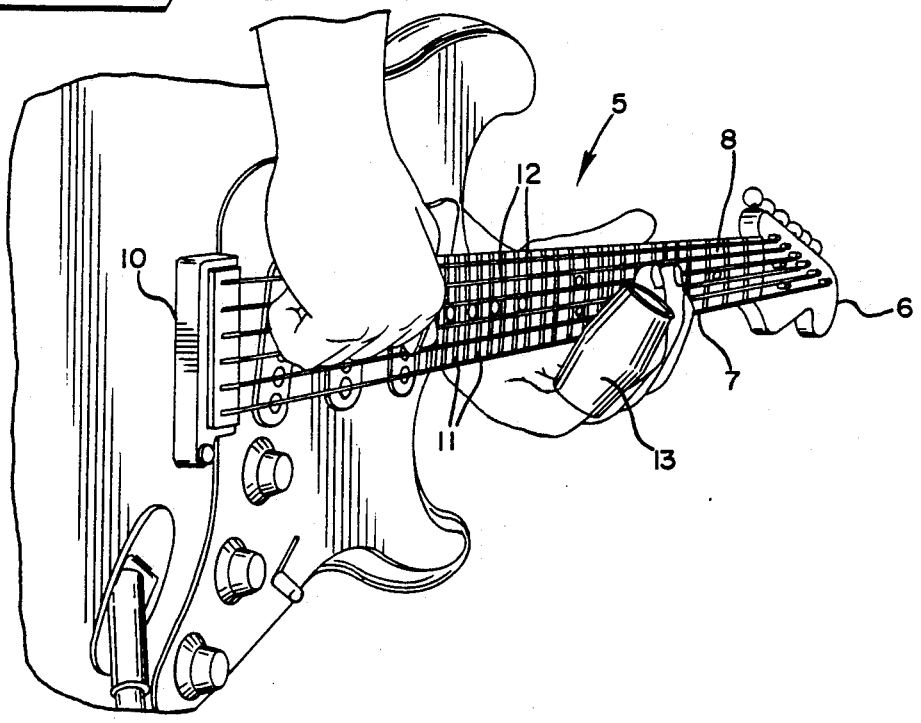
FIG. 1 is a perspective view showing a conventional guitar and illustrating the manner in which the device of the present invention is utilized by a player of the guitar.

Referring to FIG. 1, a conventional guitar is indicated generally at 5 having a head stock 6, neck 7, fret board 8 and bridge 10. On the fret board 8 there are the usual frets 11. The guitar 5 is a six-string guitar and six-strings 12 extend between the bridge 10 and the headstock 6.

In FIG. 1 the right hand of the player is shown in a position to pluck or pick the strings 12 while the player's left hand is in position so that the fingers engage the strings 12 and press the strings down at various points in the manner well understood for playing a guitar. The player is shown to have a pitch changing device or slide bar 13 on the little finger of the left hand, the slide bar 13 being an embodiment of the present invention.

Figure 2:
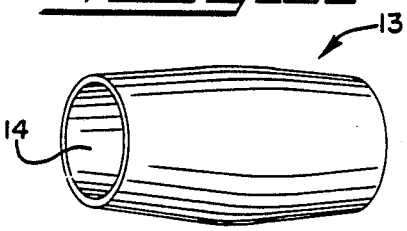
FIG. 2 is a side perspective view of a preferred embodiment of the invention.

Referring to FIG. 2, it will be seen that the slide bar 13 is a tubular body. The slide bar 13 may be formed of any suitable solid material such as metal, plastic, glass or ceramic, ir wood. The bore opening 14 that extends through the slide bar 13 is of uniform diameter whereas the outer surface is larger in the middle and tapers towards the opposite ends. Preferably the outer surfaces of the end portions 15—15 are frusto-conical in shape while the outer surface of the mid-portion 16 is arcuate and convex. Thus, the outer surface of the slide bar 13 from end to end is generally convex. The combined axial lengths of the ends 15 substantially exceed the length of the intermediate arcuate mid-portion 16.

Figure 3:
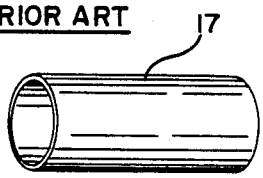
FIG. 3 PRIOR ART
FIG. 3 is a side and end perspective view of a pitch changing device or slide bar of the prior art.

The convexity of the outer surface of the slide bar 13 permits the slide bar to be used in a different manner than it has been possible heretofore to use conventional slide bars which have cylindrical outer surfaces. A conventional slide bar having a cylindrical outer surface and typifying the prior art is indicated at 17 in FIG. 3.

In playing a guitar, the player nomally achieves desired changes of notes or pitch by using the fingers to press down the strings and does not normally use a slide bar or pitch changing device continuously. These devices are used intermittently and particularly in the playing of certain types of music, such as The Blues. When used, the slide bars allow a smooth and continuous transition from note to note rather than the discrete changes which occur when the fingers alone are relied on. This smooth and continuous transition obtained with a slide bar produces a distinct effect and sound which is sometimes desired.

Since the outer cylindrical surface of the prior art slide bar 17 consists of straight lines it will be seen that it can be used to press down either of the two outermost strings 12 by applying the slide bar at an angle to the fret board 8, without engaging and pressing down adjacent string or strings. However, if it is desired to press down any string intermediate between the two outer strings by using the prior art cylindrical slide bar 17, several adjacent strings will be simultaneously pressed down along with the desired string. This results in what is referred to as "drag noise" from the adjacent strings which is undesirable and interferes with the smooth and continuous transition of the desired notes from the selected string or strings.

Figure 4:
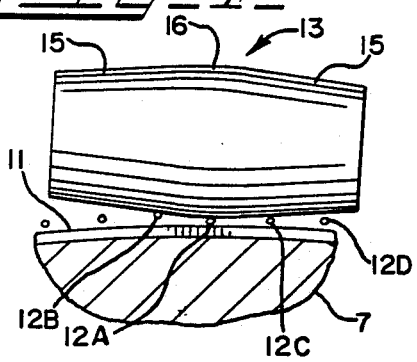
FIG. 4 is a fragmentary view on enlarged scale showing the use of the pitch changing device of the present invention in holding down a single string of a guitar.

The convexity of the outer surface of the slide bar 13 allows the player to isolate and press down on any particular string 12 without simultaneously engaging or pressing down on an adjacent string. The achievement of this desired result is illustrated in FIG. 4 wherein the slide bar 13 is shown pressing string 12A against the fret 11 without pressing down the adjacent strings 12B and 12C.

Figure 5:
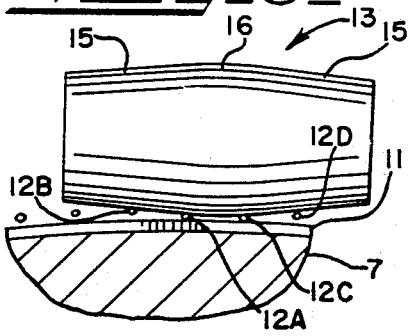
FIG. 5 is a view similar to FIG. 4 showing the pitch changing device of the present invention holding down two adjacent strings.

There may be instances where it is desired to press down simultaneously on two strings with a slide bar and this result can be obtained as is illustrated in FIG. 5 wherein the slide bar 13 is shown depressing strings 12A and 12C without engaging or pressing down on strings 12B and 12D adjacent thereto.

What is claimed is:

1. A pitch changing device to be temporarily worn on the finger of a guitar player for selectively engaging any one string on a guitar with or without engaging an adjacent string, comprising, a solid tubular member having a longitudinally convex outer surface the bore through said device being sized to permit the player to readily place said device on and remove the same from a finger.

2. The pitch changing device of claim 1 wherein the end portions of the outer surface are frusto-conical and the intermediate portion is arcuately convex.

3. The pitch changing device of claim 2 wherein the combined longitudinal length of said end portions is substantially greater than the longitudinal length of said intermediate portion.

4. The pitch changing device of claim 1 wherein the convexity of said convex outer surface permits the player to selectively apply said device to a single string or two adjacent strings.

* * * * *